US005437935A

United States Patent [19]

Fredeen

[11] Patent Number: 5,437,935

[45] Date of Patent: Aug. 1, 1995

[54] GAME BIRD FEATHER MOUNT

[75] Inventor: Vernon W. Fredeen, Brooklyn Center, Minn.

[73] Assignee: Summer Time Products, Inc., Brooklyn Center, Minn.

[21] Appl. No.: 218,438

[22] Filed: Mar. 28, 1994

[51] Int. Cl.[6] ..... B44C 5/04; B44C 5/06

[52] U.S. Cl. ..... 428/542.4; 428/6; 428/16; 428/913.3; 434/296

[58] Field of Search ..... 428/542.4, 913.3, 16, 428/6; 434/296

[56] References Cited

U.S. PATENT DOCUMENTS

| | | | |
|---|---|---|---|
| 2,260,787 | 10/1941 | Nichols et al. | 248/39 |
| 2,354,118 | 7/1944 | Hansen | 120/1 |
| 2,604,211 | 7/1952 | Steine | 211/69 |
| 2,729,452 | 1/1956 | Baumann | 273/150 |
| 4,142,012 | 2/1979 | Clamage | 428/8 |
| 5,087,012 | 2/1992 | Doublet | 248/512 |

OTHER PUBLICATIONS

"Turkey & Turkey Hunting" magazine, pp. 75–77, Apr., 1993.

Cabela's Spring 1994 Catalog, Cabela's Inc., p. 180, Dec. 1994.

"Turkey Call" magazine, Mar./Apr. 1994 issue, p. 97.

*Primary Examiner*—Alexander S. Thomas

*Attorney, Agent, or Firm*—John W. Bunch

[57] ABSTRACT

A mount (10) for conveniently and realistically displaying the feathers (18) of a game bird, such as a wild turkey, includes a frame (12) and mounting block (14) with predetermined rows of holes (36, 38 and 40) for receiving the feathers. If desired, means (42) can also be provided for displaying the beard (20) of the wild turkey. Additional embodiments (50, 70 and 80) are also disclosed.

20 Claims, 4 Drawing Sheets

GAME BIRD FEATHER MOUNT

TECHNICAL FIELD

The present invention relates generally to mounts and display devices. More particularly, this invention concerns a mount for displaying the feathers of a game bird, such as turkey tail feathers.

BACKGROUND ART

Hunters sometimes wish to keep and display part of the game killed as a memento or trophy. It could be just the head and/or antlers in the case of large game, or the entire animal or bird in the case of small game. This requires special skills and techniques which have typically been performed by taxidermists.

The feathers of certain game birds serve the same purpose. For example, wild turkeys have tail feathers that are rather unique and colorful. Four species of wild turkeys are found in North America. In addition to tail feathers, their beards correspond to their age or size, like the number of points on the antlers or rack of a deer correspond to its age/size. Wild turkeys are generally too large for mounting by a taxidermist, which would also be quite expensive. A common practice in the past has been to mount the tail and tail feathers on a board, however, there have been various drawbacks to with this approach. For example, special techniques including the use of tanning agents have been required which are expensive and time consuming. Also, since the tail feathers of a wild turkey consist of more than one layer, it has been difficult to simulate this in realistic fashion merely by mounting them on a flat board.

Heretofore there has not been available a mount which is particularly adapted for conveniently displaying the feathers of a game bird, such as turkey tail feathers, in realistic fashion.

SUMMARY OF INVENTION

The present invention comprises a game bird feather mount which overcomes the foregoing and other difficulties associated with the prior art. In accordance with the invention, there is provided a mount for conveniently and realistically displaying the feathers of a game bird, such as the tail feathers of a wild turkey. The mount herein includes a picture frame, the front of which can be used for recording certain details about the hunt such as the time and place, species of game, size, etc. Secured to the rear of the frame is a mounting block having a generally semi-circular arrangement of radially extending holes. In the preferred embodiment, a plurality of rows of holes of different sizes are provided for receiving the inner ends of the feathers pulled from the bird. A suitable hanger is also provided for hanging the mount on the wall. If desired, a place can also be provided on the underside of the block for attaching the beard. Additional embodiments are disclosed for displaying feathers from more than one game bird.

BRIEF DESCRIPTION OF DRAWINGS

A better understanding of the invention can be had by reference to the following Detailed Description in conjunction with the accompanying Drawing, wherein.

DETAILED DESCRIPTION

Figure 1:
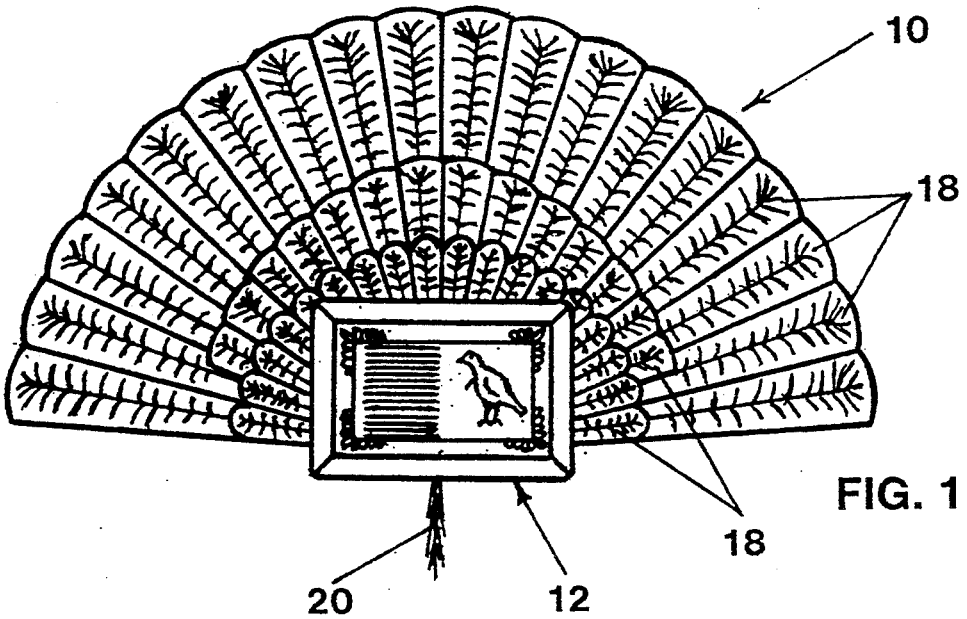
FIG. 1 is a front view of a game bird feather mount incorporating a first embodiment of the invention.
Figure 3:
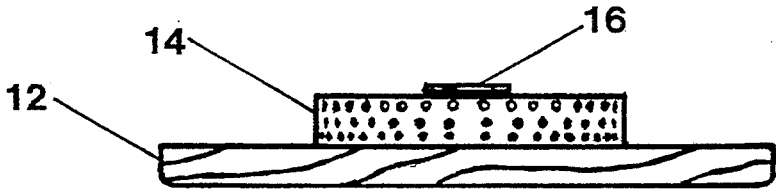
FIG. 3 is a top plan view thereof.
Figure 4:
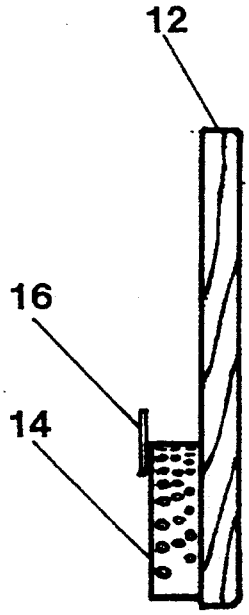
FIG. 4 is a side elevational view thereof.

Referring now to the Drawing, wherein like reference numerals designate like or corresponding elements throughout the views, and particularly referring to FIGS. 1–7, there is shown a game bird feather mount 10 incorporating a first embodiment of the invention. As will be explained more fully hereinafter, the mount 10 is particularly adapted for conveniently and realistically displaying the feathers of a game bird, such as the tail feathers of a wild turkey. Although the mount 10 is particularly suited for use with wild turkeys, it will be understood that it could also be used for mounting feathers from other types of wild game birds such as pheasant, grouse, etc.

Figure 2:
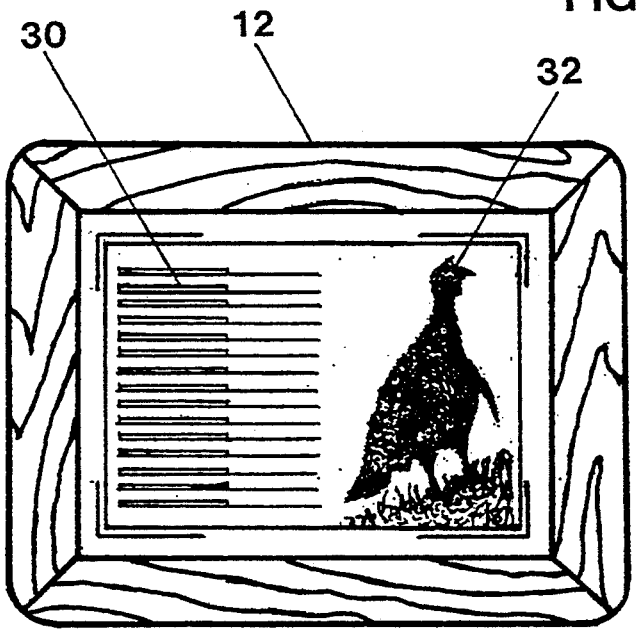
FIG. 2 is an enlarged front view thereof, minus the feathers.
Figure 5:
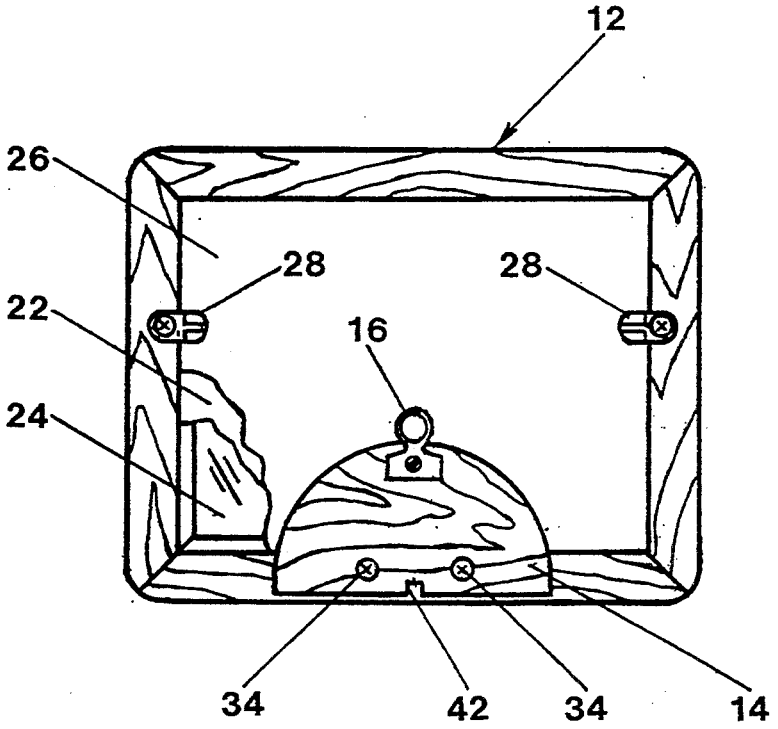
FIG. 5 is a rear view (partially cutaway) thereof.

The mount 10 includes a picture frame 12, a standoff mounting block 14 secured to the back of the frame, and a hanger 16 for hanging the mount on a wall. The mount 10 is particularly adapted for displaying the tail feathers 18 and beard 20 from a wild turkey. In particular, the picture frame 12 includes a certificate 22 sandwiched in conventional fashion between a front glass 24 and a rear backing 26, which is removably secured by a pair of retainers 28 provided on opposite sides of the back of the picture frame. The picture frame 12 may be of any suitable size, such as 7×9 or 10×12 inches. In the preferred embodiment, the picture frame 12 is formed of wood and the backing 26 is formed of foamcore, although any suitable material can be utilized. The certificate 22 is preferably comprised of paper, with the front including on one side places 30 for entry of various details concerning the hunt with the other side bearing a drawing or picture 32 of the game taken, as best seen in FIG. 2. For example, some of the information which could be recorded at 30 would be the name of the hunter, the season/date/time/location of the hunt, the species/gender of the game, the type of weapon/amunition used, etc. If desired, a snapshot (not shown) can be placed over the figure or drawing 32 in order to further personalize the mount 10.

Figure 7:
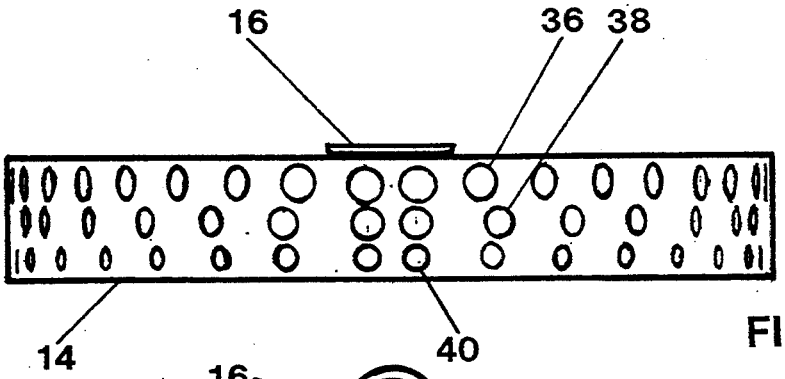
FIGS. 6 and 7 are enlarged front and top views, respectively, of the mounting block.
Figure 6:
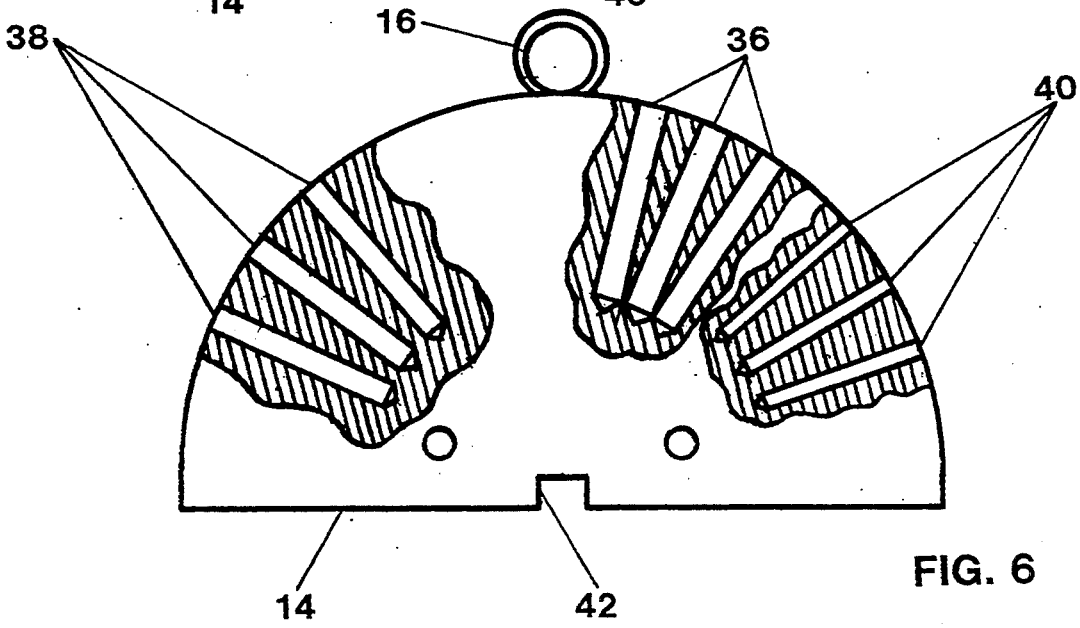

The mounting block 14 is secured to the rear of frame 12 by means of screws 34 or other suitable fasteners. The mounting block 14 is of generally semicircular or semi-cylindrical shape with a perforated periphery. The outer periphery of the mounting block 14 includes radially extending holes therein for receiving the inner ends of the feathers 18 and holding them in a fan-like pattern. In particular, as is best seen in FIGS. 6 and 7, the mounting block 14 includes three rows of circumferentially spaced-apart, radially extending holes 36, 38 and 40. The large holes 36 are circumferentially spaced-apart at generally constant intervals except for the middle pair of holes, which are relatively closer. The intermediate holes 38 are also circumferentially spaced-apart at generally constant intervals, but somewhat longer than that of the large holes 36, except for the middle pair of holes, which are also relatively closer as illustrated. The small holes 40 are arranged similarly, but with approximately the same spacing as the intermediate holes 38. The holes 36, 38 and 40 are dimensioned in accordance with the sizes of the feathers of the particular game bird. For example, in the case of turkey tail feathers, the eighteen holes 36 of about 3/16 inch diameter and 1 13/16 inch length; fourteen intermediate holes 38 of about 5/32 inch diameter AND ⅛ inch length; and sixteen small holes 40 of about 7/64 inch diameter and 1 inch length would be provided.

This arrangement of multiple rows of predetermined mounting holes 36, 38 and 40 comprises a significant feature of the present invention. This provides both a convenient and realistic display of the feathers 18, which are simply pulled out of the game bird and inserted into the mount 10 without requiring any tanning agents or other special techniques.

In accordance with the preferred embodiment, a notch 42 is also provided on the underside of the mounting block 14 for securing the beard 20 therein, such as by means of adhesive.

Figure 8:
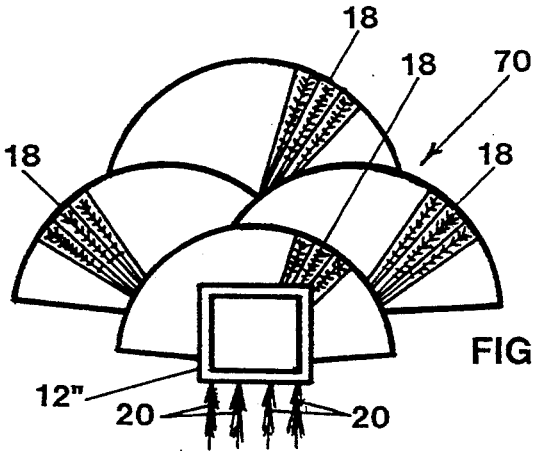
FIG. 8 is a front view of a game bird feather mount incorporating a second embodiment of the invention.
Figure 9:
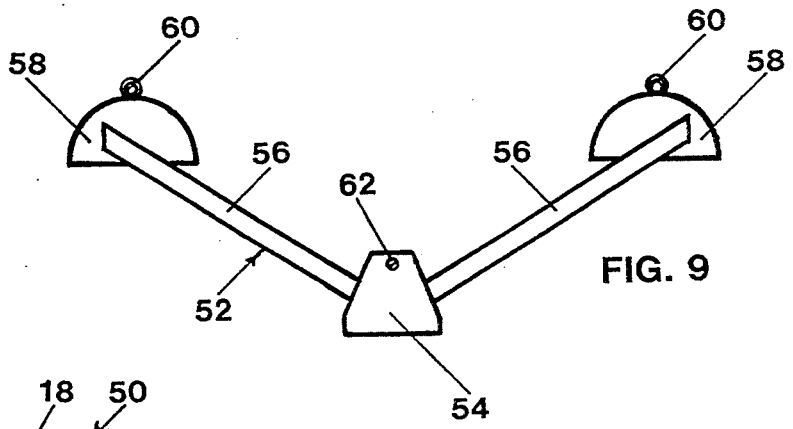
FIG. 9 is an enlarged front view of the adapter thereof.

FIGS. 8 and 9 show a game bird feather mount 50 incorporating a second embodiment of the invention. The mount 50 includes some component parts which are substantially similar to component parts of the mount 10 herein. The same reference numerals have been used to identify such component parts, but with prime (′) notations for differentiation. In contrast to the mount 10, which can display only one set of feathers 18 and one beard 20 from a turkey, the mount 50 is adapted for displaying three beards and corresponding sets of feathers. This is accomplished by means of an adapter 52 incorporating a center block 54 connected by arms 56 to two additional mourning blocks 58, each of which is constructed like mounting block 14. The arms 56 are arranged in a generally shallow V-shape with hangers 60 similarly provided on the block 58 for hanging adapter 52 on a wall. A raised screw 62 is provided on the from of the center block 54 for hanging the mourn 10 thereon by hanger 16.

Figure 10:
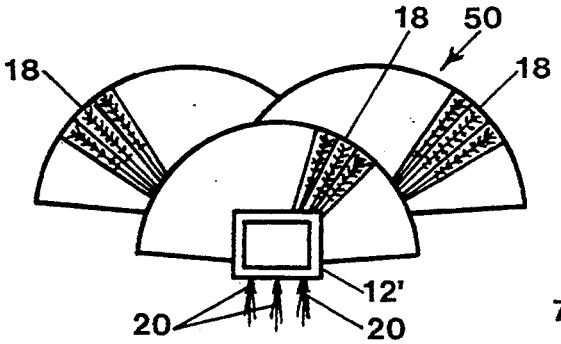
FIG. 10 is a front view of a game bird feather mount incorporating a third embodiment of the invention.
Figure 11:
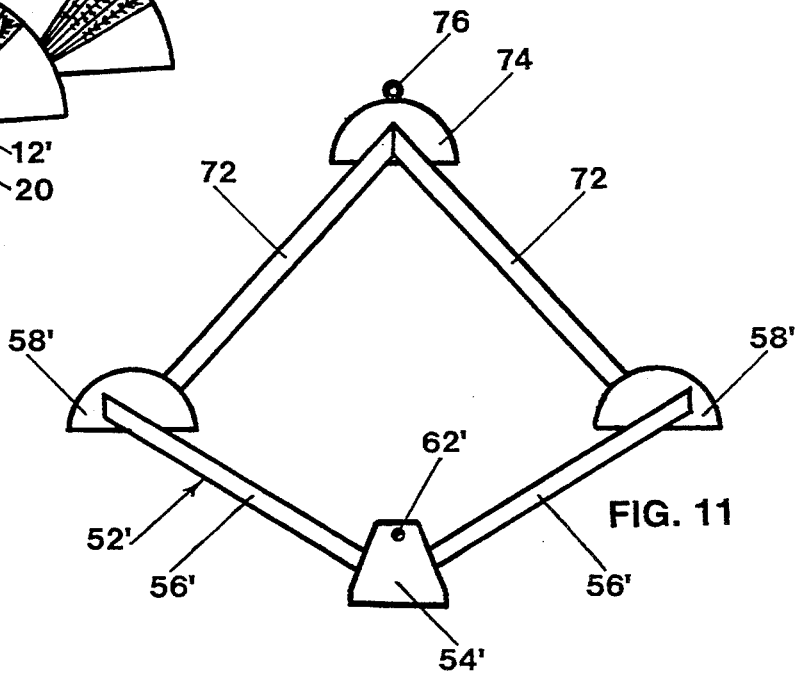
FIG. 11 is an enlarged front view of the adapter thereof.

FIGS. 10 and 11 show a game bird feather mourn 70 incorporating a third embodiment of the invention. The mourn 70 incorporates some component parts which are substantially similar to component parts of the mourns 10 and 50 herein. The same reference numerals have been used to identify such component parts, but with prime (′) and double prime (″) notations, respectively, for differentiation. In contrast to the mourns 10 and 50, the mourn 70 is adapted for displaying four beards 20 and corresponding sets of tail feathers 18 from different turkeys. For example, the mourn 70 could be used in the case of achieving what is known as a grand slam, meaning one of each of the four different species of wild turkeys found in North America. In order to do so, the adapter 52 includes two additional arms 72 and one additional mourning block 74 similar to the mourning block 12 herein. A hanger 76 is also provided on the mounting block 74. Otherwise, the mount 70 is substantially similar in construction and function to the mourns 10 and 50 herein.

Figure 12:
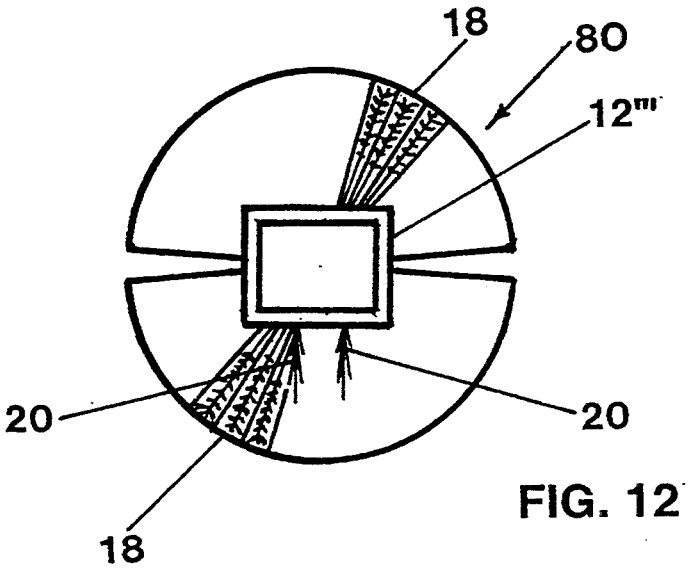
FIG. 12 is a front view of a game bird feather mount incorporating a forth embodiment of the invention.
Figure 13:
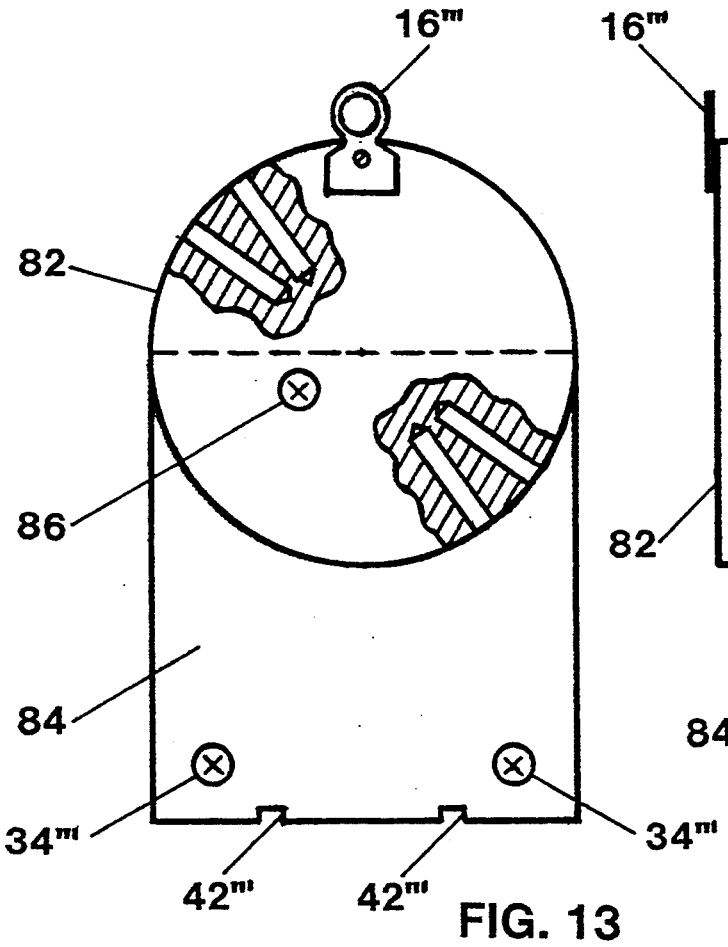
FIG. 13 is an enlarged rear view (partially cut away) of the mounting block thereof.
Figure 14:
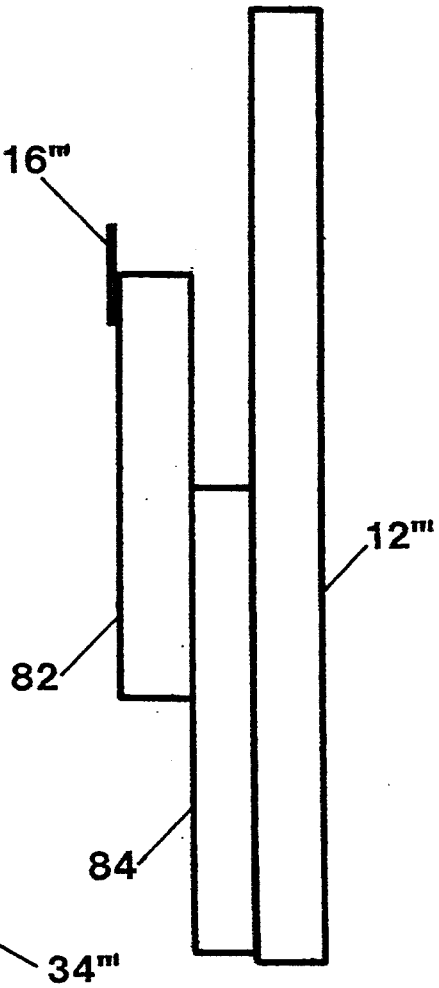
FIG. 14 is a side elevational view thereof.

FIGS. 12–14 show a game bird feather mount 80 incorporating a fourth embodiment of the invention, which is adapted for displaying two sets of beards 20 and corresponding feathers 18 from two turkeys. The mount 80 incorporates some component parts which are substantially similar to component parts of the mount 10 herein. The same reference numerals have been used to identify such component parts but with triple prime (‴) notations for differentiation. In contrast to the mounts of the other embodiments, the mount 80 uses a circular mounting block 82 with similar arrangement of holes on opposite sides thereof, like two blocks 14 secured in back to back relationship, with the two notches 42 being provided on a rectangular block 84 which is secured at its upper end to the perforated mounting block 82 by screws 86, only one of which is shown. The lower part of block 84 is secured to frame 12‴ by screws 34‴. Otherwise, the mount 80 is substantially similar in construction and function to the other embodiments herein.

From the foregoing it will thus be appreciated that the present invention comprises a new and improved game bird feather mount having several advantages over the prior art. By means of the invention feathers can simply be pulled from the bird and inserted for realistic and convenient display without using any tanning agents or special techniques. Other advantages will be evident to those skilled in the art.

Although particular embodiments of the invention have been illustrated in the accompanying Drawing and described in the foregoing Detailed Description, will be understood that the invention is not limited only to the embodiments disclosed, but is intended to embrace any alternatives, equivalents, modifications and/or rearrangements of elements falling within the scope of the invention as defined by the following claims.

What is claimed is:

1. Apparatus for mounting and displaying feathers from a game bird, which comprises:

a picture frame having front and back sides;

a mounting block secured to the back side of said picture frame;

said mounting block including a multiplicity of radially extending circumferentially spaced-apart predetermined holes arranged in generally parallel rows for receiving the feathers therein; and means secured to said mounting block for hanging the apparatus on a wall.

2. The apparatus of claim 1, wherein the holes in adjacent rows of holes in said mounting block are of different diametric sizes.

3. The apparatus according to claim 2, wherein the holes are also of different depths.

4. The apparatus of claim 1, wherein the holes in said mounting block are arranged in three rows with the holes in each row being of the same diametric size.

5. The apparatus of claim 1, wherein the holes in said mounting block are of a plurality of different diametric sizes, with the smallest holes being located in a row adjacent to said picture frame.

6. The apparatus of claim 1, wherein the feathers consist of tail feathers from a wild turkey.

7. The apparatus of claim 1, further including:

means for suspending a beard from a wild turkey on said mounting block.

8. The apparatus of claim 7, further including:

adapter means for mounting and displaying additional feathers from another game bird or fowl.

9. Apparatus for mounting and displaying feathers from a game bird, which comprises:

a picture frame having front and back sides;

a first mounting block secured to the back side of said picture frame;

said first mounting block including a multiplicity of radially extending circumferentially spaced-apart predetermined holes arranged in at least one row for receiving feathers from one game bird therein; and a second mounting block;

said second mounting block including a multiplicity of radially extending circumferentially spaced-apart predetermined holes arranged in at least one row for receiving feathers from another game bird therein;

means for interconnecting said first and second mounting blocks; and means for hanging the apparatus on a wall.

10. The apparatus of claim 9, wherein the holes in each mounting block are arranged in parallel rows with adjacent rows of holes in said mounting blocks being of different diametric sizes.

11. The apparatus according to claim 10, wherein the holes are also of different depths.

12. The apparatus of claim 9, wherein the holes in each mounting block are arranged in three rows with the holes in each row being of the same diametric size.

13. The apparatus of claim 9, wherein the holes in each mounting block are of a plurality of different diametric sizes.

14. Apparatus for mounting and displaying feathers from a game bird from a hunt, which comprises:

a picture frame having front and back sides;

a mounting block secured to the back side of said picture frame;

said mounting block including two groups of holes therein, each group having a multiplicity of radially extending circumferentially spaced-apart predetermined holes arranged in generally parallel rows for receiving the feathers therein; and means for hanging the apparatus on a wall.

15. The apparatus of claim 14, wherein the holes in adjacent rows of holes in said mounting block are of different diametric sizes.

16. The apparatus according to claim 15, wherein the holes are also of different depths.

17. The apparatus of claim 14, wherein the holes in said mounting block are arranged in three rows with the holes in each row being of the same diametric size.

18. The apparatus of claim 14, wherein the holes in said mounting block are of a plurality of different diametric sizes, with the smallest holes being located in a row adjacent to said picture frame.

19. The apparatus of claim 14, wherein the feathers consist of tail feathers from a wild turkey.

20. The apparatus of claim 14, further including:

means for suspending a beard from a wild turkey on said mounting block.

* * * * *